US005931650A

United States Patent [19]

Yasu et al.

[11] Patent Number: 5,931,650

[45] Date of Patent: Aug. 3, 1999

[54] HERMETIC ELECTRIC SCROLL COMPRESSOR HAVING A LUBRICATING PASSAGE IN THE ORBITING SCROLL

[75] Inventors: Toshiharu Yasu, Shiga-ken; Manabu Sakai, Kusatsu; Yoshiharu Takeuchi, Ootsu; Kiyoji Aburaya, Ootsu; Shoji Aoshika, Ootsu; Tsutayoshi Narita, Omihachiman, all of Japan

[73] Assignee: Matsushita Electric Industrial Co., Ltd., Osaka, Japan

[21] Appl. No.: 08/868,722

[22] Filed: Jun. 4, 1997

[51] Int. Cl.[6] ..... F04C 18/04; F04C 29/02

[52] U.S. Cl. ..... 418/55.3; 418/55.4; 418/55.6; 418/94; 418/99

[58] Field of Search ..... 418/55.3, 55.4, 418/55.6, 94, 99, 100

[56] References Cited

U.S. PATENT DOCUMENTS 5,178,527 1/1993 Jung ..... 418/55.6
5,217,359 6/1993 Kawahara et al. ..... 418/99
5,645,408 7/1997 Fujio et al. ..... 418/55.6

FOREIGN PATENT DOCUMENTS 4334701 11/1992 Japan ..... 418/55.6

*Primary Examiner*—John J. Vrablik
*Attorney, Agent, or Firm*—McDermott, Will & Emery

[57] ABSTRACT

A hermetic electric scroll compressor includes a fixed scroll and an orbiting scroll which define therebetween a plurality of compression spaces for compressing fluid introduced via a suction port. The orbiting scroll has a base plate and a shaft portion extending from the base plate toward a crankshaft rotatably supported by a support member. A seal member is disposed between the base plate and the support member to define an inner region and an outer region. The shaft portion is exposed to the inner region, while the outer region communicates with the suction port. The shaft portion is formed with an axial hole open to the inner region, while the base plate is formed with a radial hole open to the outer region. Communication is established between the axial and radial holes via a small-diameter hole so that lubricating oil supplied to the inner region is introduced into the outer region via the small-diameter hole for feeding to the compression spaces via the suction port.

11 Claims, 5 Drawing Sheets

HERMETIC ELECTRIC SCROLL COMPRESSOR HAVING A LUBRICATING PASSAGE IN THE ORBITING SCROLL

BACKGROUND OF THE INVENTION

1. Field of the Invention

The present invention relates to a hermetic electric scroll compressor for compressing fluid, such as air or refrigerant gas.

2. Description of the Prior Art

As shown in FIG. 5, a hermetic electric scroll compressor includes, in a sealed casing 101, an electric motor 102 and a compression unit 105 driven by the electric motor 102 whose rotation force is transmitted to the compression unit 105 via a crankshaft 104 rotatably supported by a support member 103. The compression unit 105 includes a fixed scroll 106 having a spiral vane and an orbiting scroll 107 having a spiral vane which is interfitted or mated with the spiral vane of the fixed scroll 106 to define therebetween a plurality of compression spaces 109. The orbiting scroll 107 is prevented from rotation on its axis by an Oldham's ring 108 interposed between the orbiting scroll 107 and the support member 103, while it makes a swing motion or an orbital motion depending on the rotation of the crankshaft 104. The orbital motion of the orbiting scroll 107 causes the compression spaces 109 formed between the spiral vanes of the fixed and orbital scrolls 106 and 107 to move toward the center and reduce their volumes to thereby compress the introduced fluid. In the scroll compressor of this type, the compression efficiency is improved by reducing leakage of the fluid through between contact surfaces of the spiral vanes of the scrolls defining the compression spaces. For reducing the fluid leakage, the technique has been known to introduce lubricating oil stored in the sealed casing 101 into the compression spaces 109 so as to seal them using oil films of the introduced lubricating oil.

In the conventional scroll compressor, the lubricating oil drawn up by a pump passes through the inside of the crankshaft 104, then a portion of the lubricating oil is fed to an eccentric bearing 111 and a bearing 110, while the other portion of the lubricating oil passes through a communication hole 112 formed in a shaft portion and a base plate of the orbiting scroll 107 and then adequate amounts of the lubricating oil are fed to the compression spaces 109 via a restrictor 113, as shown in FIG. 6, disposed in the base plate of the orbiting scroll 107.

In the foregoing scroll compressor, it is necessary to incorporate the restrictor 113, as a separate member, into the orbiting scroll 107. This results in additional manufacturing cost and additional assembling step of the restrictor 113. Further, owing to a difference in thermal expansion coefficient between the restrictor 113 and the orbiting scroll 107, the lubricating oil exceeding the adequate amounts may flow into the compression spaces 109 due to temperature increase during operation of the compressor. This lowers the compression efficiency of the compressor.

Further, key portions of the Oldham's ring 108 and corresponding key grooves of the orbiting scroll 107 which slidably receive therein the key portions of the Oldham's ring 108 are in a boundary lubrication state so that, if the lubricating oil supplied thereto becomes insufficient, the key portions of the Oldham's ring 108 and the key grooves of the orbiting scroll 107 may be subjected to abnormal abrasion, thereby lowering the mechanical efficiency.

Further, since the communication hole 112 has an outlet only in one direction, the uniform supply of the lubricating oil is difficult to cause insufficient sealing of the compression spaces 109.

SUMMARY OF THE INVENTION

Therefore, it is an object of the present invention to provide an improved hermetic electric scroll compressor that can eliminate one or more of the foregoing disadvantages.

According to one aspect of the present invention, a hermetic electric scroll compressor comprises a sealed casing; a fixed scroll provided in the sealed casing, the fixed scroll having a first spiral vane; an orbiting scroll provided in the sealed casing, the orbiting scroll having a base plate provided with a second spiral vane which is mated with the first spiral vane to define therebetween a plurality of compression spaces, the orbiting scroll further having a shaft portion extending from the base plate toward a crankshaft which is rotatably supported by a support member fixed in the sealed casing; a rotation preventing mechanism provided between the base plate and the support member for preventing rotation of the orbiting scroll on its axis; a drive mechanism for causing an orbital motion of the orbiting scroll by transmitting a rotation force of an electric motor to the shaft portion via the crankshaft, the orbital motion reducing volumes of the compression spaces for compressing fluid introduced via a suction port; and a seal member disposed between the base plate and the support member for defining an inner region and an outer region, the shaft portion of the orbiting scroll exposed to the inner region, while the outer region communicating with the suction port, wherein the shaft portion is formed with an axial hole open to the inner region and extending in an axial direction of the crankshaft, and the base plate is formed with a radial hole open to the outer region and extending in a radial direction relative to the crankshaft, and wherein communication is established between the axial hole and the radial hole via a small-diameter hole so that lubricating oil supplied to the inner region is introduced into the outer region via the small-diameter hole for feeding to the compression spaces via the suction port.

It may be arranged that the rotation preventing mechanism comprises an Oldham's ring having a key portion, and that the radial hole opens to a key groove which is formed on the base plate and slidably receives therein the key portion, the key groove exposed to the outer region.

It may be arranged that the small-diameter hole is bored in the base plate of the orbiting scroll.

According to another aspect of the present invention, a hermetic electric scroll compressor comprises a sealed casing; a fixed scroll provided in the sealed casing, the fixed scroll having a first spiral vane; an orbiting scroll provided in the sealed casing, the orbiting scroll having a base plate provided with a second spiral vane which is mated with the first spiral vane to define therebetween a plurality of compression spaces, the orbiting scroll further having a shaft portion extending from the base plate toward a crankshaft which is rotatably supported by a support member fixed in the sealed casing; a rotation preventing mechanism provided between the base plate and the support member for preventing rotation of the orbiting scroll on its axis; a drive mechanism for causing an orbital motion of the orbiting scroll by transmitting a rotation force of an electric motor to the shaft portion via the crankshaft, the orbital motion reducing volumes of the compression spaces for compressing fluid introduced via a suction port; and a seal member disposed between the base plate and the support member for defining an inner region and an outer region, the shaft portion of the orbiting scroll exposed to the inner region, while the outer region communicating with the suction port, wherein the shaft portion is formed with an axial hole open to the inner region and extending in an axial direction of the crankshaft, and the base plate is formed with a plurality of radial holes open to the outer region and extending in radial directions relative to the crankshaft, and wherein communication is established between the axial hole and each of the radial holes via a small-diameter hole so that lubricating oil supplied to the inner region is introduced into the outer region via the small-diameter holes for feeding to the compression spaces via the suction port.

It may be arranged that the rotation preventing mechanism comprises an Oldham's ring having key portions, and that the radial holes open to key grooves which are formed on the base plate and slidably receive therein the corresponding key portions, respectively, the key grooves exposed to the outer region.

It may be arranged that the small-diameter holes are bored in the base plate of the orbiting scroll.

It may be arranged that the number of the radial holes is two and the radial holes are arranged in a diametrical direction.

BRIEF DESCRIPTION OF THE DRAWINGS

The present invention will be understood more fully from the detailed description given hereinbelow, taken in conjunction with the accompanying drawings.

In the drawings:

FIGS. 2A and 2B are diagrams showing an orbiting scroll of the compressor according to the first preferred embodiment, wherein FIG. 2A is a perspective view of the orbiting scroll and FIG. 2B is a sectional view thereof;

FIGS. 3A and 3B are diagrams showing an orbiting scroll of a hermetic electric scroll compressor according to a second preferred embodiment of the present invention, wherein FIG. 3A is a perspective view of the orbiting scroll and FIG. 3B is a sectional view thereof;

DESCRIPTION OF THE PREFERRED EMBODIMENT

Now, a first preferred embodiment of the present invention will be described hereinbelow with reference to FIGS. 1, 2A and 2B.

Figure 1:
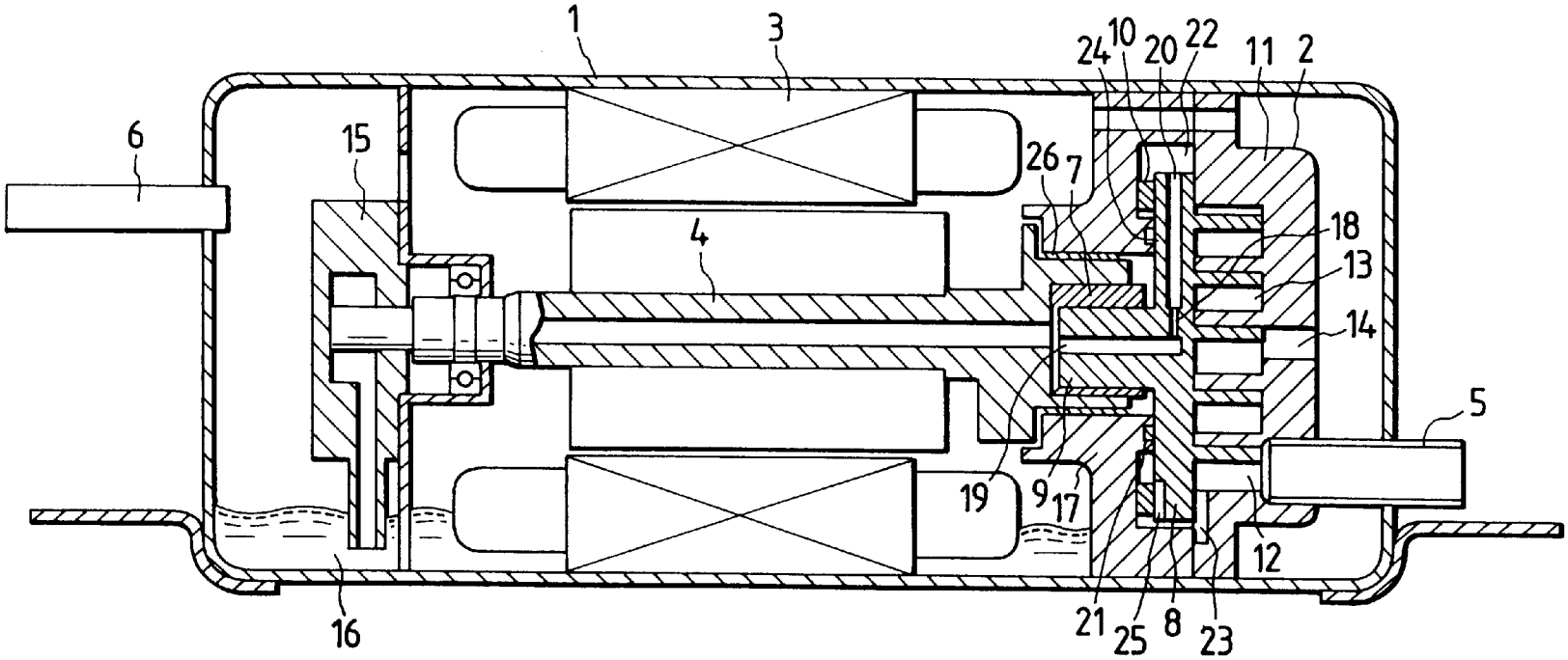
FIG. 1 is a sectional view of a hermetic electric scroll compressor according to a first preferred embodiment of the present invention.
Figure 2A:
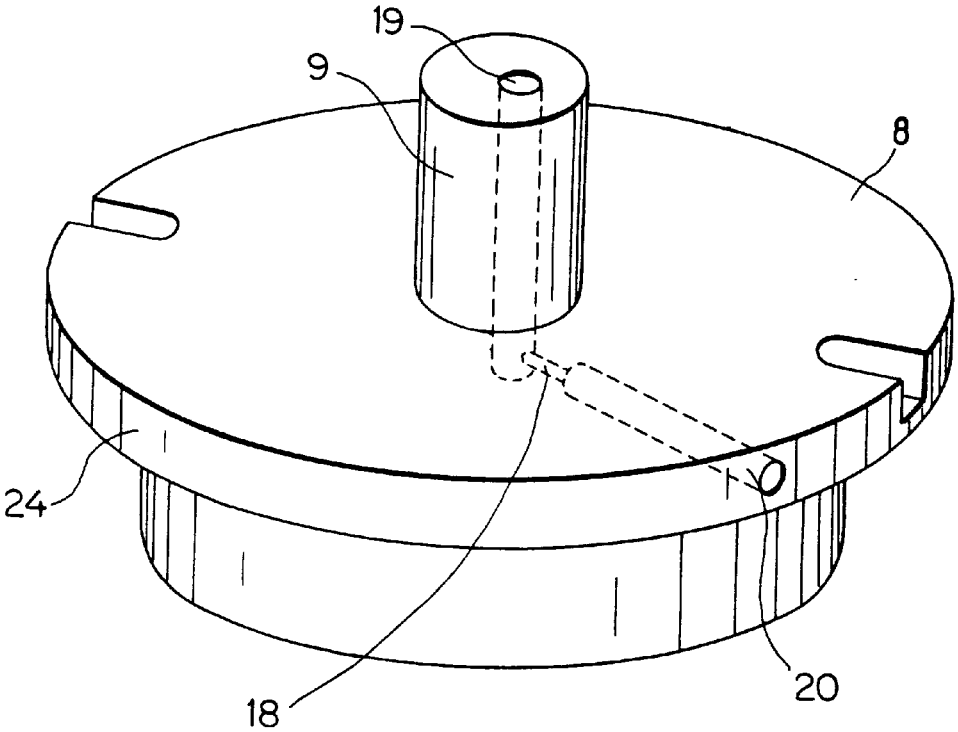
Figure 2B:
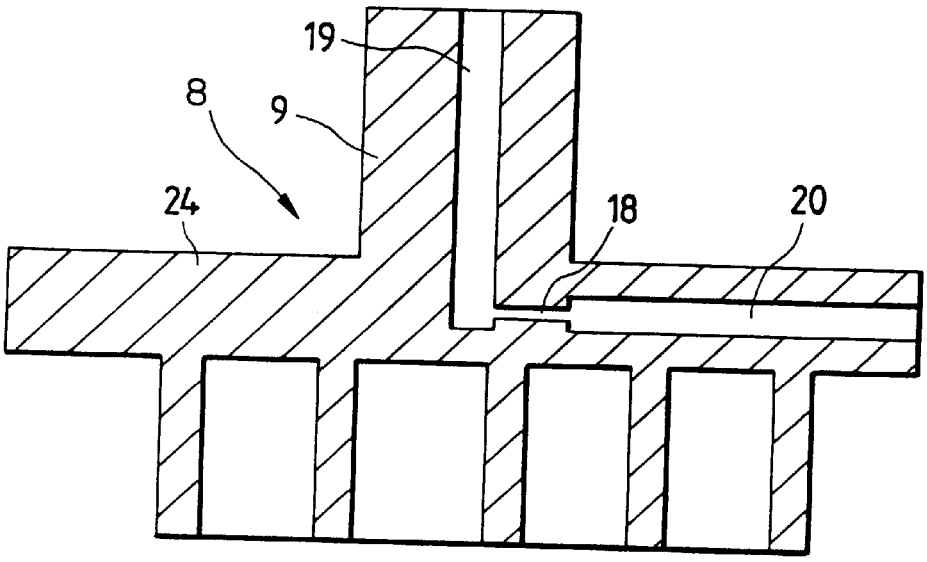

Referring to FIG. 1, a hermetic electric scroll compressor includes, in a sealed casing 1, a compression unit 2, an electric motor 3, and a crankshaft 4 for transmitting a rotation force of the electric motor 3 to the compression unit 2. The crankshaft 4 is rotatably supported at one end thereof by a bearing 26 disposed between the crankshaft 4 and a support member 17 fixed to the sealed casing 1. The compression unit 2 includes a fixed scroll 11 having a base plate and a spiral vane provided on one side of the base plate. The compression unit 2 further includes an orbiting scroll 8 having a base plate 24 and a spiral vane provided on one side of the base plate 24. The base plate 24 is further provided with a shaft portion 9 on a side thereof opposite to the side where the spiral vane is provided. The spiral vanes of the scrolls 8 and 11 are interfitted or mated with each other to define therebetween a plurality of compression spaces 13. The sealed casing 1 further includes therein an inlet pipe 5 for introducing low-pressure refrigerant gas and an outlet pipe 6 for discharging high-pressure refrigerant gas compressed by the compression unit 2 to the exterior of the sealed casing 1.

When the electric motor 3 is driven, the rotation force is generated and transmitted to the compression unit 2 via the crankshaft 4. Specifically, the rotation force is transmitted to the shaft portion 9 of the orbiting scroll 8 via an eccentric bearing 7 disposed between the crankshaft 4 and the shaft portion 9 of the orbiting scroll 8. Since the orbiting scroll 8 is prevented from rotation on its axis by an Oldham's ring 10 interposed between the orbiting scroll 8 and the support member 17, it makes a swing motion or an orbital motion depending on the rotation of the crankshaft 4. The orbital motion of the orbiting scroll 8 causes the compression spaces 13 to move toward the center and reduce their volumes. Thus, the low-pressure refrigerant gas introduced via the inlet pipe 5 and a suction port 12 of the compression unit 2 is successively compressed in the compression spaces 13.

Subsequently, the compressed high-pressure refrigerant gas is discharged to the inside of the sealed casing 1 via a discharge port 14 of the compression unit 2 and then discharged to the exterior of the sealed casing 1 via the outlet pipe 6.

On the other hand, lubricating oil drawn up from an lubricating oil storage 16 by a pump 15 provided at the other end of the crankshaft 4 passes through the inside of the crankshaft 4, that is, via a passage formed through the crankshaft 4, toward the shaft portion 9 of the orbiting scroll 8. Then, a portion of the lubricating oil is fed to an inner region defined by a seal member 21 disposed between the support member 17 and the base plate 24 of the orbiting scroll 8. The inner region surrounds the shaft portion 9 of the orbiting scroll 8. In the inner region, the lubricating oil is fed to the eccentric bearing 7 and the bearing 26 for lubrication thereof, and then returned to the lubricating oil storage 16. The other portion of the lubricating oil is fed to an outer region 22 defined by the seal member 21 via a lubricant passage formed in the shaft portion 9 and the base plate 24 of the orbiting scroll 8. Specifically, as best shown in FIGS. 2A and 2B, the shaft portion 9 is formed with an axial hole 19 open to the foregoing inner region and extending in the axial direction of the crankshaft 4, and the base plate 24 is formed with a radial hole 20 open to the foregoing outer region 22 and extending in the radial direction relative to the crankshaft 4, and further, a small-diameter radial hole 18 working as an orifice is directly bored in the base plate 24 to establish communication between the axial hole 19 and the radial hole 20 so as to achieve the foregoing lubricant passage. The lubricating oil fed to the outer region 22 is then introduced into the compression spaces 13 via a communication groove 23 formed on the fixed scroll 11 and communicating with the suction port 12 for sealing the compression spaces 13.

According to the foregoing first preferred embodiment, adequate amounts of the lubricating oil are introduced into the compression spaces 13 via the lubricant passage having the axial hole 19 and the radial hole 20 which communicate with each other via the small-diameter hole 18 directly formed therebetween. Thus, the compression spaces 13 are sealed by oil films of the introduced lubricating oil so that the leakage of the refrigerant gas during compression can be reduced to achieve the high compression efficiency. Further, since the supply amount of the lubricating oil can be easily adjusted by properly determining the diameter and length of the small-diameter hole 18, the separate restrictor as required in the prior art is not required in the foregoing first preferred embodiment. This can eliminate the additional manufacturing cost and the additional assembling step of the restrictor and further prevent dispersion of the supply amounts of the lubricating oil which would be otherwise caused depending on the assembled states of the restrictor in the base plate of the orbiting scroll.

Now, a second preferred embodiment of the present invention will be described hereinbelow with reference to FIGS. 3A and 3B.

Figure 3A:
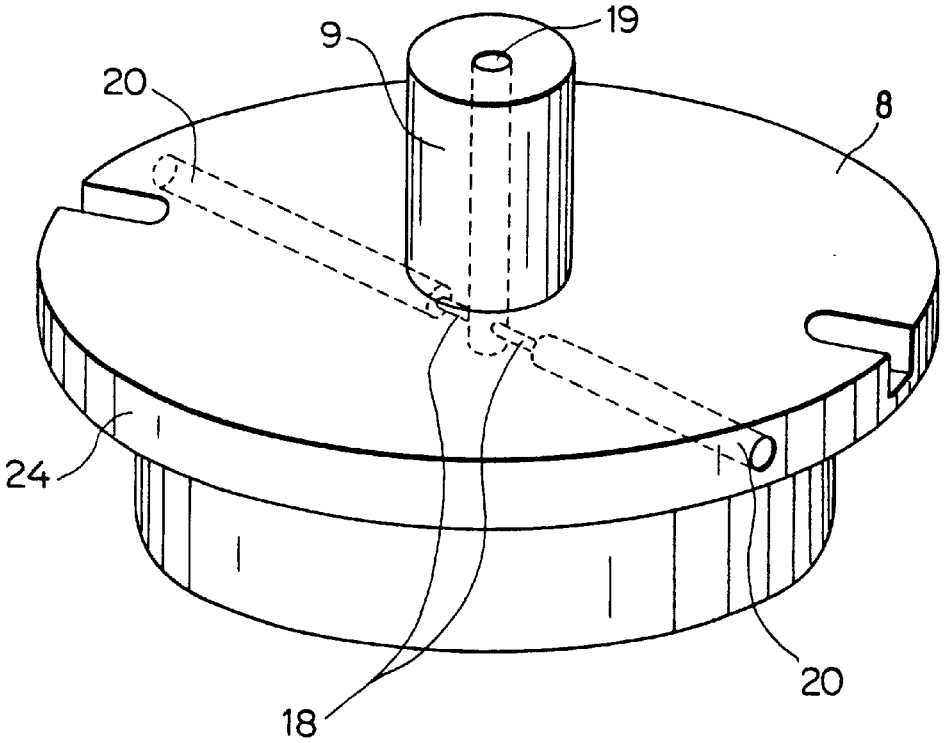
Figure 3B:
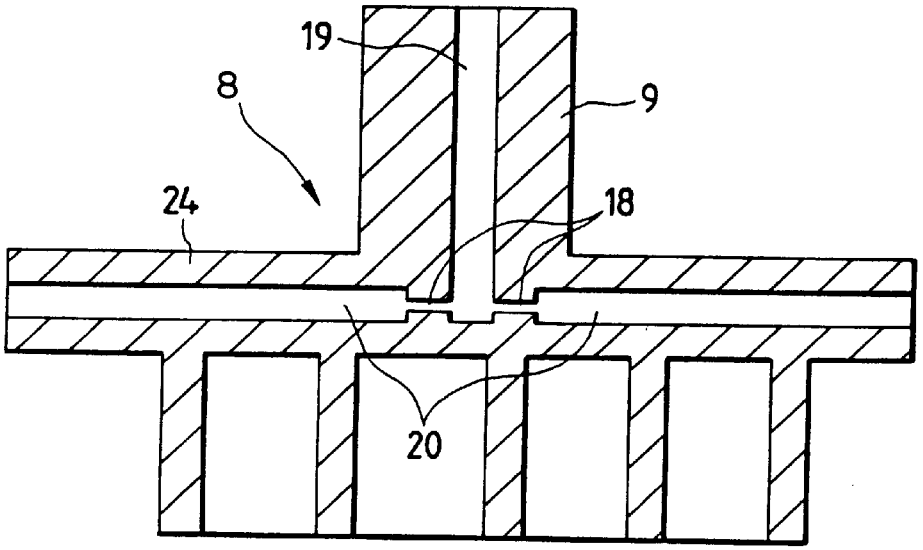

The second preferred embodiment differs from the first preferred embodiment only in that, as shown in FIGS. 3A and 3B, the base plate 24 of the orbiting scroll 8 is formed with a pair of small-diameter radial holes 18 and a pair of radial holes 20 which are arranged in a diametrical direction. The other structure is the same as that of the first preferred embodiment. Specifically, the shaft portion 9 of the orbiting scroll 8 is formed with an axial hole 19 open to the foregoing inner region and extending in the axial direction of the crankshaft 4, and each of the radial holes 20 opens to the foregoing outer region 22 and extends in the radial direction relative to the crankshaft 4, and further, each of the small-diameter radial holes 18 is directly formed in the base plate 24 to establish communication between the axial hole 19 and the corresponding radial hole 20.

The number of the radial holes 20 may be three or more with the corresponding number of the small-diameter holes 18.

With this arrangement, in addition to the advantages achieved by the foregoing first preferred embodiment, the lubricating oil can be uniformly introduced into the compression spaces 13 for sealing them. Further, the lubricating oil can be uniformly and sufficiently fed to the surface of the fixed scroll 11 on which the base plate 24 of the orbiting scroll 8 slides.

Now, a third preferred embodiment of the present invention will be described hereinbelow with reference to FIG. 4.

Figure 4:
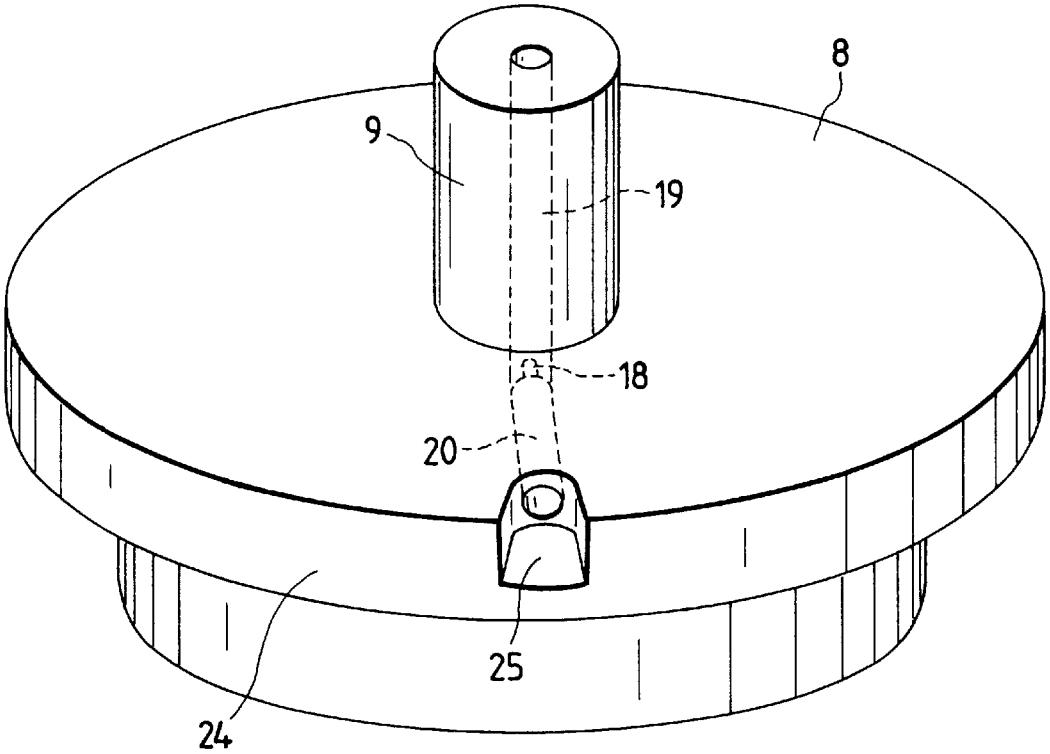
FIG. 4 is a perspective view of an orbiting scroll of a hermetic electric scroll compressor according to a third preferred embodiment of the present invention.
Figure 5:
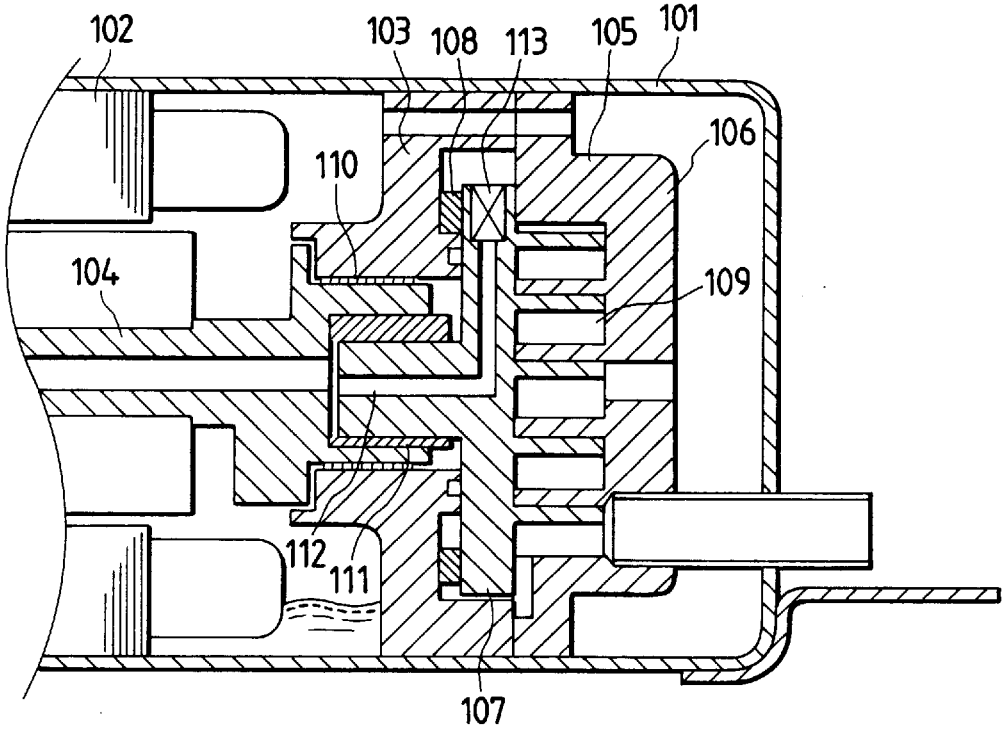
FIG. 5 PRIOR ART
FIG. 5 is a partial sectional view of a conventional hermetic electric scroll compressor.
Figure 6:
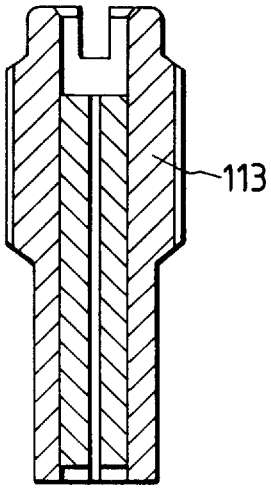
FIG. 6 PRIOR ART
FIG. 6 is a sectional view of a restrictor incorporated in the conventional compressor shown in FIG. 5.

The third preferred embodiment differs from the second preferred embodiment only in that, as shown in FIG. 4, each of axial holes 20 opens to corresponding one of key grooves 25 which are formed on the base plate 24 of the orbiting scroll 8 and face the foregoing outer region 22, respectively. As appreciated, each of the key grooves 25 slidably receives therein corresponding one of key portions of the Oldham's ring 10.

The other structure is the same as that of the foregoing second preferred embodiment.

With this arrangement, in addition to the advantages achieved by the foregoing second preferred embodiment, the lubricating oil can be sufficiently fed to the key grooves 25. Accordingly, the key portions of the Oldham's ring 10 and the key grooves 25 of the orbiting scroll 8 are prevented from being subjected to abnormal abrasion, thereby avoiding lowering of the mechanical efficiency.

While the present invention has been described in terms of the preferred embodiments, the invention is not to be limited thereto, but can be embodied in various ways without departing from the principle of the invention as defined in the appended claims.

What is claimed is:

1. A hermetic electric scroll compressor comprising:

a sealed casing;

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression spaces, said orbiting scroll further having a shaft portion extending from said base plate toward a crankshaft which is rotatably supported by a support member fixed in the sealed casing;

a rotation preventing mechanism provided between said base plate and said support member for preventing rotation of said orbiting scroll on its axis;

a drive mechanism for causing an orbital motion of said orbiting scroll by transmitting a rotation force of an electric motor to said shaft portion via said crankshaft, said orbital motion reducing volumes of said compression spaces for compressing fluid introduced via a suction port; and a seal member disposed between said base plate and said support member for defining an inner region and an outer region, said shaft portion of the orbiting scroll exposed to said inner region, while said outer region communicating with said suction port, wherein said shaft portion is formed with an axial hole open to said inner region and extending in an axial direction of said crankshaft, and said base plate is formed with a radial hole open to said outer region and extending in a radial direction relative to said crankshaft, and wherein communication is established between said axial hole and said radial hole via a small-diameter hole so that lubricating oil supplied to said inner region is introduced into said outer region via said small-diameter hole for feeding to said compression spaces via said suction port, said small-diameter hole being formed directly in said orbiting scroll and integrally contiguous with said axial hole and said radial hole.

2. The compressor according to claim 1, wherein said small-diameter hole is located at a radial end of said radial hole remote from its other end open to said outer region.

3. the compressor according to claim 1, wherein said small-diameter hole is located between an axial end of said axial hole remote from its other end open to said inner region and a radial end of said radial hole remote from its other end open to said outer region.

4. A hermetic scroll compressor comprising:

a sealed casing;

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression spaces, said orbiting scroll further having a shaft portion extending from said base plate toward a crankshaft which is rotatable supported by a support member fixed in the sealed casing;

a rotation preventing mechanism provided between said base plate and said support member for preventing rotation of said orbiting scroll on its axis;

a drive mechanism for causing an orbital motion of said orbiting scroll by transmitting a rotation force of an electric motor to said shaft portion via said crankshaft, said orbital motion reducing volumes of said compression spaces for compressing fluid introduced via a suction port; and a seal member disposed between said base plate and said support member for defining an inner region and an outer region, said shaft portion of the orbiting scroll exposed to said inner region, while said outer region communicating with said suction port, wherein said shaft portion is formed with an axial hole open to said inner region and extending in an axial direction of said crankshaft, and said base plate is formed with a radial hole open to said outer region and extending in a radial direction relative to said crankshaft, and wherein communication is established between said axial hole and said radial hole via a small-diameter hole so that lubricating oil supplied to said inner region is introduced into said outer region via said small-diameter hole for feeding to said compression spaces via said suction port, wherein said rotation preventing mechanism comprises an Oldham's ring having a key portion, and wherein said radial hole opens to a key groove which is formed on said base plate and slidably receives therein said key portion, said key groove exposed to said outer region.

5. A hermetic scroll compressor comprising:

a sealed casing;

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression spaces, said orbiting scroll further having a shaft portion extending from said base plate toward a crankshaft which is rotatable supported by a support member fixed in the sealed casing;

a rotation preventing mechanism provided between said base plate and said support member for preventing rotation of said orbiting scroll on its axis;

a drive mechanism for causing an orbital motion of said orbiting scroll by transmitting a rotation force of an electric motor to said shaft portion via said crankshaft, said orbital motion reducing volumes of said compression spaces for compressing fluid introduced via a suction port; and a seal member disposed between said base plate and said support member for defining an inner region and an outer region, said shaft portion of the orbiting scroll exposed to said inner region, while said outer region communicating with said suction port, wherein said shaft portion is formed with an axial hole open to said inner region and extending in an axial direction of said crankshaft, and said base plate is formed with a radial hole open to said outer region and extending in a radial direction relative to said crankshaft, and wherein communication is established between said axial hole and said radial hole via a small-diameter hole so that lubricating oil supplied to said inner region is introduced into said outer region via said small-diameter hole for feeding to said compression spaces via said suction port, wherein said small-diameter hole is bored in said base plate of the orbiting scroll.

6. A hermetic electric scroll compressor comprising:

a sealed casing;

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression spaces, said orbiting scroll further having a shaft portion extending from said base plate toward a crankshaft which is rotatably supported by a support member fixed in the sealed casing;

a rotation preventing mechanism provided between said base plate and said support member for preventing rotation of said orbiting scroll on its axis;

a drive mechanism for causing an orbital motion of said orbiting scroll by transmitting a rotation force of an electric motor to said shaft portion via said crankshaft, said orbital motion reducing volumes of said compression spaces for compressing fluid introduced via a suction port; and a seal member disposed between said base plate and said support member for defining an inner region and an outer region, said shaft portion of the orbiting scroll exposed to said inner region, while said outer region communicating with said suction port, wherein said shaft portion is formed with an axial hole open to said inner region and extending in an axial direction of said crankshaft, and said base plate is formed with a plurality of radial holes open to said outer region and extending in radial directions relative to said crankshaft, and wherein communication is established between said axial hole and each of said radial holes via a small-diameter hole so that lubricating oil supplied to said inner region is introduced into said outer region via said small-diameter holes for feeding to said compression spaces via said suction port, said small-diameter holes being formed directly in said orbiting scroll and integrally contiguous with said axial hole and said radial holes.

7. The compressor according to claim 6, wherein the number of said radial holes is two and said radial holes are arranged in a diametrical direction.

8. The compressor according to claim 6, wherein each of said small-diameter holes is located at a radial end of the corresponding radial hole remote from its other end open to said outer region.

9. The compressor according to claim 6, wherein each of said small-diameter holes is located between an axial end of said axial hole remote from its other end open to said inner region and a radial end of the corresponding radial hole remote from its their end open to said outer region.

10. A hermetic scroll compressor comprising:

a sealed casing;

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression spaces, said orbiting scroll further having a shaft portion extending from said base plate toward a crankshaft which is rotatably supported by a support member fixed in the sealed casing;

a rotation preventing mechanism provided between said base plate and said support member for preventing rotation of said orbiting scroll on its axis;

a drive mechanism for causing an orbital motion of said orbiting scroll by transmitting a rotation force of an electric motor to said shaft portion via said crankshaft, said orbital motion reducing volumes of said compression spaces for compressing fluid introduced via a suction port; and a seal member disposed between said base plate and said support member for defining an inner region and an outer region, said shaft portion of the orbiting scroll exposed to said inner region, while said outer region communicating with said suction port, wherein said shaft portion is formed with an axial hole open to said inner region and extending in an axial direction of said crankshaft, and said base plate is formed with a plurality of radial holes open to said outer region and extending in radial directions relative to said crankshaft, and wherein communication is established between said axial hole and each of said radial holes via a small-diameter hole so that lubricating oil supplied to said inner region is introduced into said outer region via said small-diameter holes for feeding to said compression spaces via said suction port, wherein said rotation preventing mechanism comprises an Olham's ring having key portions, and wherein said radial holes open to key grooves which are formed on said base plate and slidably receive therein the corresponding key portions, respectively, said key grooves exposed to said outer region.

11. A hermetic scroll compressor comprising:

a sealed casing;

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression spaces, said orbiting scroll further having a shaft portion extending from said base plate toward a crankshaft which is rotatably supported by a support member fixed in the sealed casing;

a rotation preventing mechanism provided between said base plate and said support member for preventing rotation of said orbiting scroll on its axis;

a drive mechanism for causing an orbital motion of said orbiting scroll by transmitting a rotation force of an electric motor to said shaft portion via said crankshaft, said orbital motion reducing volumes of said compression spaces for compressing fluid introduced via a suction port; and a seal member disposed between said base plate and said support member for defining an inner region and an outer region, said shaft portion of the orbiting scroll exposed to said inner region, while said outer region communicating with said suction port, wherein said shaft portion is formed with an axial hole open to said inner region and extending in an axial direction of said crankshaft, and said base plate is formed with a plurality of radial holes open to said outer region and extending in radial directions relative to said crankshaft, and wherein communication is established between said axial hole and each of said radial holes via a small-diameter hole so that lubricating oil supplied to said inner region is introduced into said outer region via said small-diameter holes for feeding to said compression spaces via said suction port, wherein said small-diameter holes are bored in said base plate of the orbiting scroll.

* * * * *